US005856813A

United States Patent [19]

Katayama et al.

[11] Patent Number: 5,856,813

[45] Date of Patent: Jan. 5, 1999

[54] ELECTROLUMINESCENT DISPLAY DEVICE FOR PERFORMING BRIGHTNESS CONTROL

[75] Inventors: Osamu Katayama; Hiroshi Uesugi, both of Nisshin; Hiroaki Tanaka, Okazaki, all of Japan

[73] Assignee: Nippondenso Company, Ltd., Kariya, Japan

[21] Appl. No.: 715,798

[22] Filed: Sep. 19, 1996

[30] Foreign Application Priority Data

Sep. 20, 1995 [JP] Japan ..... 7-241089

[51] Int. Cl.[6] ..... G09G 3/30

[52] U.S. Cl. ..... 345/76; 345/208

[58] Field of Search ..... 345/76, 77, 208

[56] References Cited

U.S. PATENT DOCUMENTS 5,075,596 12/1991 Young et al. ..... 345/76

FOREIGN PATENT DOCUMENTS 2-103590 4/1990 Japan .

7-281641 10/1995 Japan .

*Primary Examiner*—Jeffery Brier

*Attorney, Agent, or Firm*—Pillsbury Madison & Sutro LLP

[57] ABSTRACT

When display data for both odd-numbered and even-numbered scan electrodes in an electroluminescent display are both actuating data, the brightness of electroluminescent elements connected to the odd-numbered electrode is adjusted by adjusting the timing for starting the application of the actuating voltage and the brightness of electroluminescent elements connected to the even-numbered electrode is adjusted by adjusting the timing for terminating the application of the actuating voltage. Moreover, electric charge in the EL elements is retained by maintaining the application of the actuating voltages during scanning operations.

9 Claims, 8 Drawing Sheets

ELECTROLUMINESCENT DISPLAY DEVICE FOR PERFORMING BRIGHTNESS CONTROL

CROSS-REFERENCE TO RELATED APPLICATION

This application is related to and claims priority from Japanese Patent Application No. Hei-7-241089, the contents of which are hereby incorporated by reference.

BACKGROUND OF THE INVENTION

1. Field of the Invention

The present invention relates to an electroluminescent display device which includes a plurality of electroluminescent elements arranged as a matrix.

2. Description of Related Art

Conventional electroluminescent display devices include a plurality of scan electrodes and data electrodes arranged as a matrix. These display devices perform matrix display by sequentially applying scan voltage to the plurality of scan electrodes and by applying actuating and deactuating display voltages to data electrodes to light up and put out EL (electroluminescent) elements provided at intersections of the scan electrodes with the data electrodes.

It must be noted here that EL elements are capacitive elements and so, electric charge stored by the EL elements during display along a scan electrode must be released before the display along the next scan electrode. However, if the electric charge of the EL elements is discharged for every scan electrode, then there will be a need for more charging and discharging circuits which, in turn, results in increased energy consumption.

Accordingly, Japanese Patent Laid open Publication No. Hei-2-103590 proposes the curbing of energy consumption by maintaining the charge of the EL element by continuing the application of display voltage when the display data for the present and the next scanning operation are the same.

Moreover, one type of EL display device performs pulse width brightness control by adjusting the application period of the actuating voltage during the application of the scan voltage.

In this way, it might be considered plausible to perform brightness control with the device disclosed in the above-described JP-A Hei-2-103590. However, the device disclosed in the same reference performs the application of only actuating and deactuating voltages and so, it cannot perform brightness control.

SUMMARY OF THE INVENTION

In view of the foregoing problems of the prior art in mind, it is a goal of the present invention to provide a display device which can perform brightness control while at the same time keeping electric consumption of the display device at a minimum.

To achieve this aim, one aspect of the present invention provides an electroluminescent display device which includes a display panel, a scan driving unit and a data driving unit. The display panel has a plurality of scan electrodes, a plurality of data electrodes perpendicular to the scan electrodes and a plurality of electroluminescent elements disposed in the intersections of the scan electrodes and the data electrodes, and connected to both the scan electrodes and the data electrodes. The scan driving unit is for sequentially applying scan voltages to the plurality of scan electrodes. The data driving unit is for performing brightness control of the electroluminescent elements by applying actuating and deactuating voltages to the data electrodes in accordance with display data, which is one of actuating and deactuating data that correspond to the actuating voltage and the deactuating voltage for actuating and deactuating the electroluminescent elements. The data driving unit adjusts a first timing for starting application of the actuating voltage to a target data electrode among the plurality of data electrodes in accordance with a first one of two successive data for the target data electrode when both of the successive data are actuating data. Also, when both of the successive data are actuating data, the data driving unit adjusts a second timing for terminating the application of the actuating voltage to the target data electrode in accordance with a second one of the successive data and maintains the application of the actuating voltage between the first timing and the second timing. In this way, the brightness of the electroluminescent elements can be controlled properly.

Preferably, the data driving unit adjusts the first timing for starting the application of the actuating voltage to each of the data electrodes when the scan driving unit applies the scan voltage to an odd-numbered scan electrode and the second timing for terminating the application of actuating voltage to each of the data electrodes when the scan driving unit applies the scan voltage to an even-numbered scan electrode.

Preferably, the data driving unit starts the application of the actuating voltage to the target data electrode before the scan driving unit applies the scan voltage to the even-numbered scan electrode connected to the target data electrode when the first one of the successive data is deactuating data and the second one of the successive data is actuating data. In this way, the actuation of the electroluminescent element connected to the even-numbered scan electrode can be performed properly in consideration of the charging time of the same electroluminescent element.

Preferably, the data driving unit terminates application of the actuating voltage to the target data electrode before the scan driving unit applies the scan voltage to the even-numbered electrode connected to the target data electrode when the first one of the successive data is actuating data and the second one of the successive data is deactuating data. In this way, the actuation of the electroluminescent element which is supposed to be deactuated can be prevented.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

Figure 1:
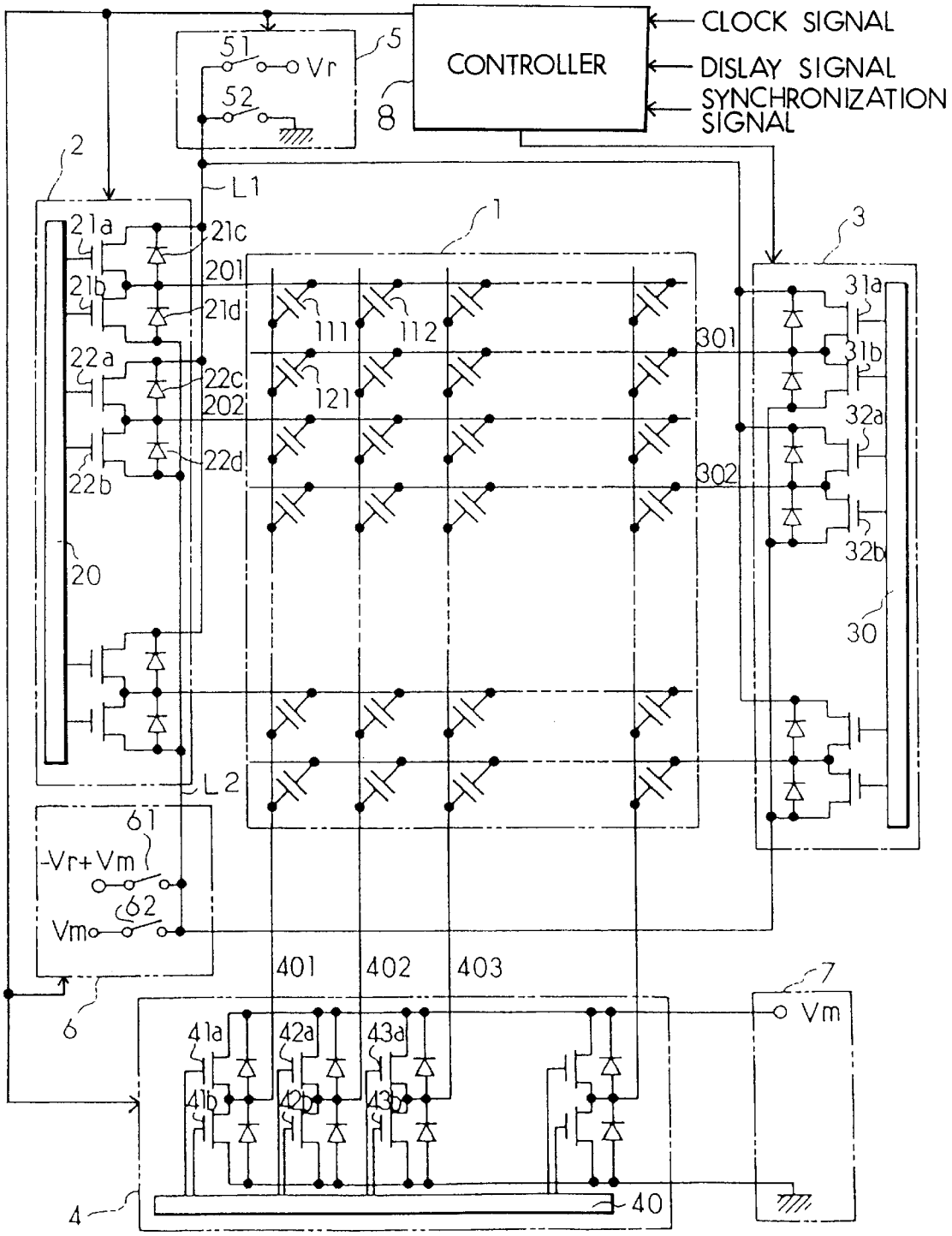
FIG. 1 shows an EL display device according to a first embodiment of the present invention.

FIG. 1 shows a construction of an EL display device according to a first embodiment of the present invention.

An EL display panel 1 includes scan electrodes and data electrodes which are formed on both sides of a luminescent layer to face each other. More concretely, as shown in FIG. 1, the EL display panel 1 includes odd-numbered row scan electrodes 201, 202, . . . , even-numbered row scan electrodes 301, 302, . . . and vertical data electrodes 401, 402, . . . It must be noted that "odd-numbered row electrodes" and the like as used hereinafter refers to the first, third, fifth and the like rows of the display panel 1. On the other hand, "even-numbered row electrodes" and the like as used hereinafter refers to the second, fourth, sixth and the like rows of the display panel 1.

EL elements 111, 112, . . . , 121, . . . are formed at the intersections of the scan electrodes 201, 301, 202, 302, . . . and the data electrodes 401, 402, 403, . . . It must be noted here that the EL elements 111, 112, . . . are denoted as capacitors in the Figure because they are capacitive elements.

Scan side driver ICs (integrated circuits) 2, 3 and a data side driver IC 4 are provided for driving the EL display panel 1.

The scan side driver IC 2 is a push-pull type driver circuit and includes P-channel FETs 21*a*, 22*a*, . . . and N-channel FETs 21*b*, 22*b*, . . . connected to odd-numbered scan electrodes 201, 202, . . . The scan side driver IC 2 applies scan voltage pulses to the odd scan electrodes 201, 202, . . . in accordance with the output from a scan controller 20.

The scan side driver IC 3 has a construction similar to that of the scan side driver IC 2. The scan side driver IC 3 includes P-channel FETs 31*a*, 32*a*, . . . and N-channel FETs 31*b*, 32*b*, . . . and supplies scan voltage to the even-numbered scan electrodes 301, 302, . . . in accordance with the output from a scan controller 30.

Meanwhile, the data side driver IC 4 includes data controller 40, P-channel FETs 41*a*, 42*a*, . . . and N-channel FETs 41*b*, 42*b*, . . . , and supplies display voltage pulses to the data electrodes 401, 402, 403, . . .

The scan side drivers IC 2, 3 are provided with scan voltage supply circuits 5, 6. The scan voltage supply circuit 5 includes switching elements 51, 52 and supplies a direct current voltage Vr or ground voltage (0 V) to a line L1, which is connected to the source of the P-channel FETs of the scan side driver ICs 2, 3, in accordance with the switching conditions of the switching elements 51, 52.

The scan voltage supply circuit 6 includes switching elements 61, 62 and supplies a direct current voltage −Vr +Vm or Vm to the source of the N-channel FETs of the scan side driver ICs 2, 3 in accordance with the switching conditions of the switching elements 61, 62.

Moreover, the data side driver IC 4 is connected to a display supply circuit 7 for supplying direct current voltage (modulation voltage) Vm to the source of the P-channel FETs 41*a*, 42*a*, 43*a*, . . . of the data side driver IC 4 and supplying 0 V to the source of the N-channel FETs 41*b*, 42*b*, 43*b*, . . . of the same data side driver IC 4.

According to the above described-arrangement, there is a need to apply an alternating current voltage pulse between the scan electrodes and the data electrodes to light up the EL elements, and accordingly, there is a need to generate a voltage pulse whose polarity reverses in the positive and negative fields for each of the scan lines to drive the display panel 1. Operations in positive and negative fields are explained hereinafter.

The operation in the positive field is first explained here. Switching elements 51, 62 are actuated and switching elements 52, 61 are deactuated to start actuation operations of the EL elements in the positive field. First, the P-channel FET 21*a* of the scan side driver IC 2 connected to the first row scan electrode 201 is actuated to set the voltage of the same scan electrode 201 to Vr. Also, output stage FETs, which are connected to the other scan electrodes, of the driver ICs 2, 3 are deactuated so that such scan electrodes are in a floating state.

Also, for data electrodes 401, 402, 403, . . . of the data side driver IC 4, the P-channel FET is deactuated and the N-channel FET is actuated for the data electrode of the EL element that is to be lit up. On the other hand, the P-channel FET is actuated and the N-channel FET is deactuated for the data electrode of the EL element that is to be put out.

In this way, the voltage of the data electrode of the EL element to be lit up becomes 0 V and a voltage of no less than the voltage Vr, which is no less than the threshold voltage, is applied to the EL element and so, the EL element lights up. Moreover, the voltage of the data electrode of the EL element to be deactuated becomes Vm and so, a voltage Vr−Vm is applied to such EL element. Because this Vr−Vm voltage is set to be less than the threshold voltage, the EL element is put out. In this way, during the positive field operation, a voltage of 0 V becomes the voltage for actuating (i.e, lighting up) the EL element while Vm becomes the voltage for deactuating (i.e., putting out) the EL element.

Subsequently, the P-channel FET 21*a* of the scan side driver IC 2 connected to the scan electrode 201 is deactuated and the N-channel FET 21*b* also connected to the scan electrode 201 is actuated to release the electric charge stored in the EL elements connected to the scan electrode 201.

Next, the P-channel FET 31*a* of the scan side driver IC 3 connected to the second row scan electrode 301 is actuated so that the voltage of the same scan electrode 301 becomes Vr. In addition, all the output stage FETs of the scan side driver ICs 2, 3 connected to the other scan electrodes are deactuated so that the rest of the scan electrodes are floating.

Also, the voltage levels of the data electrodes 401, 402, 403, . . . are adjusted so that the EL elements connected to the scan electrode 301 are properly lit up and put out, and thus, the actuation and deactuation of the second row of EL elements can be performed in the same way as that of the first embodiment.

Subsequently, the P-channel FET 31*a* of the scan side driver IC 3 connected to the second row of scan electrode 301 is deactuated with the N-channel FET 31*b* being actuated to release the electric charge stored by the EL elements connected to the scan electrode 301. It must be noted here that the above described operations are repeated up to the bottom row scan electrode to perform successive linear scanning.

Operations in the negative field are explained hereinafter. Here, switching elements 52, 61 are actuated while switching elements 51, 62 are deactuated to perform successive linear scanning in the same as that in the positive field.

In this case, −Vr +Vm is applied to the scan electrode which performs the display operation. For the data electrode side, as opposed to the operation in the positive field, the voltage of the data electrode of the EL element to be actuated is set to Vm while the voltage of the data electrode of the EL element that is to be deactuated is set to 0 V.

Therefore, for the scan electrode which has −Vr +Vm applied thereto, if Vm is applied to the data electrode, then voltage across the EL element becomes −Vr and so, the EL element lights up. On the other hand, if the voltage of the data electrode is 0 V, then the EL element will not be actuated because the voltage across it will be −Vr +Vm, which is lower than the threshold voltage.

One cycle of display operations is executed by driving the display panel 1 in the negative and positive fields and thus, the panel is driven by repeatedly performing these operations.

It must be noted here that the above-described switching elements 51, 52, 61, 62, the scan side driver ICs 2, 3 and the data side driver IC 4 are controlled based on control signals from a controller 8. To put it more concretely, the controller 8 receives clock, display and synchronization signals to control the switching of the switching elements 51, 52, 61, 62 during operations in the positive and negative fields and to execute control operations for sequentially generating scanning voltages from the scan side driver ICs 2, 3 and for generating display voltages from the data side driver IC 4.

Figure 2:
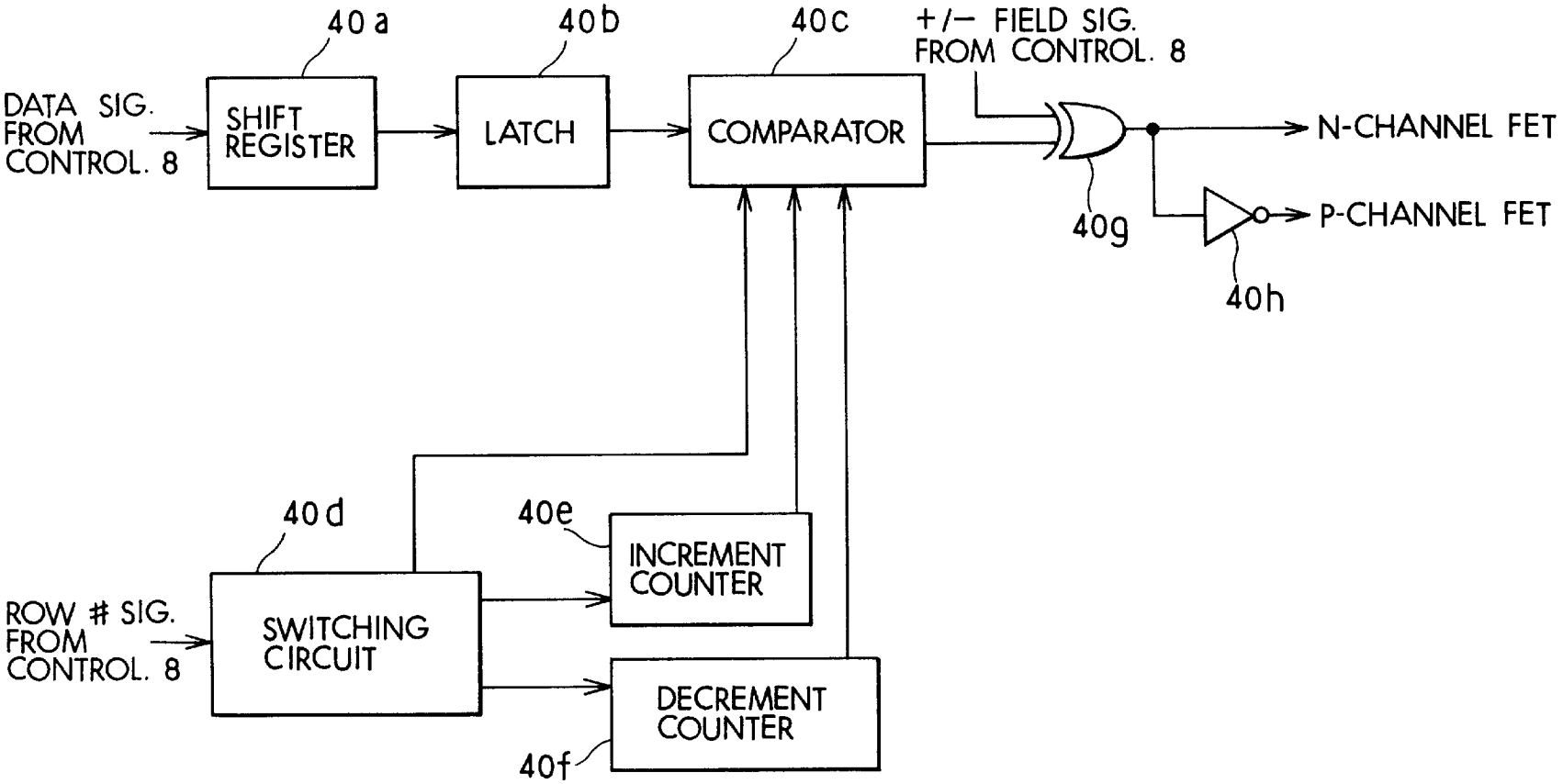
FIG. 2 is a block diagram of a circuit for performing brightness control according to the first embodiment.

With the above-described basic construction, the present embodiment provides a circuit shown in FIG. 2 for performing pulse width gradation display. The circuit shown in FIG. 2 is installed inside the control circuit 40 and is provided for each of the data electrodes 401, 402, 403, . . .

As shown in FIG. 2, a shift register 40*a* receives sequential display data from the controller 8 for performing pulse width brightness control with such display data being retained by a latch 40*b*. It must be noted here that the shift register 40*a* receives display data for the next scanning operation while, on the other hand, the latch 40*b* stores the display data for the present scanning operation.

A switching circuit 40*d* selectively actuates an increment counter 40*e* and a decrement counter 40*f* based on a signal it receives from the controller 8. That is, when the scan electrode is an odd-numbered row electrode, the switching circuit 40*d* actuates the decrement counter 40*f*. On the other hand, the switching circuit 40*d* actuates the increment counter 40*e* when the scan electrode is an even-numbered row electrode. In synchronization with the timing of the application of the scan voltages, both the increment counter 40*e* and the decrement counter 40*f* are reset based on a signal from the controller 8 (not shown). During such resetting, the count value of the increment counter 40*e* is set to be 0 while the count value of the decrement counter 40*f* is set to a maximum value.

A comparator 40*c* compares the display data retained by the latch 40*b* and the count value of the counter selected by the switching circuit 40*d*. The output signal of the comparator 40*c* is provided to an exclusive OR circuit 40*g* with the signal corresponding to either the positive field or the negative field generated by the controller 8 being provided to the same exclusive OR circuit 40*g*. The output signal of the exclusive OR circuit 40*g* is provided to the N-channel FETs. P-channel FETs also receive the same output signal of the exclusive OR circuit 40*g* via an inverter 40*h*.

During operations in the positive field, it must be noted here that the N-channel FETs are actuated and the voltages of the data electrodes are set to 0 V when the count value is no less than the above-described display data. Otherwise, the P-channel FETs are actuated and the voltages of the data electrodes are set to Vm. Also, during operations in the negative field, because the signal provided to the exclusive OR circuit 40*g* from the controller 8 is inverted, the operations of the N-channel FETs and the P-channel FETs with respect to the output signal of the comparator 8 are also reversed.

Next, the lighting up of the EL elements in the odd-numbered scan electrodes and the even-numbered scan electrodes of the display panel 1 is explained with reference to the time chart of FIG. 3.

Figure 3:
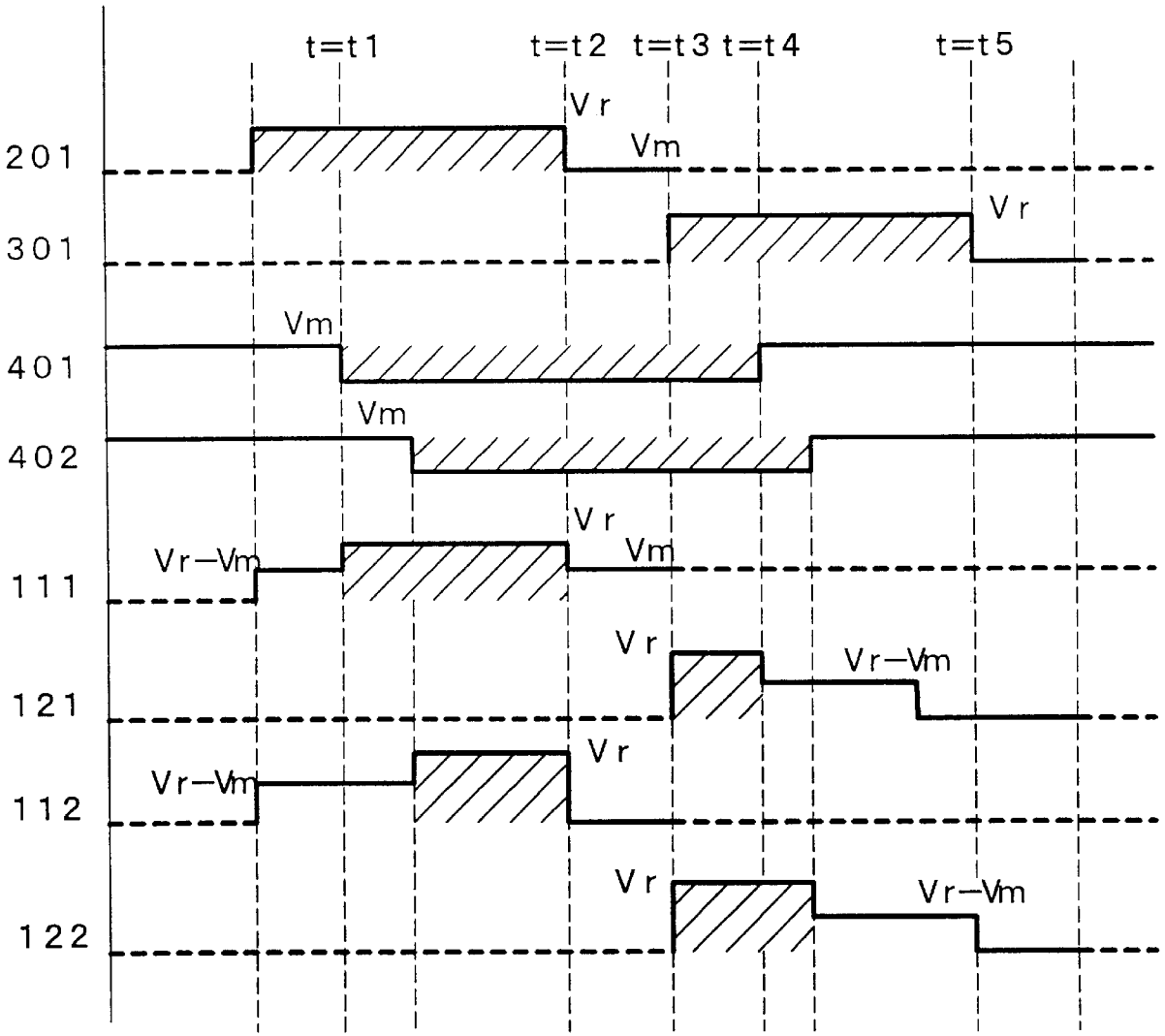
FIG. 3 is a time chart showing the operation of the EL display device according to the first embodiment.

As shown in FIG. 3, a scan voltage V201 is applied to the odd-numbered scan electrode 201. Synchronous to such application of the scan voltage, the switching circuit 40*d* selects the decrement counter 40*f*. At the same time, the increment counter 40*e* and the decrement counter 40*f* are both reset and the decrement counter 40*f* begins counting down from the maximum value.

Also, if the display data being retained by the latch 40*b* is n, then when the count value of the decrement counter 40*f* becomes n (at t=t1), an actuation voltage V401, i.e., 0 V, is applied to the data electrode 401 based on the output signal from the comparator 40*c*. Thus, the EL element 111 begins to light up as it has voltage Vr applied thereto as V401. For this case, the value n of the display data is for setting the timing of commencing the application of the voltage for lighting the EL element and brightness control can be performed by adjusting the duration of the actuation of the EL elements by varying the value n of the display data. At the end of the application of the scan voltage (at t=t2), the lighting of the EL element ends because the voltage applied to it becomes lower than the threshold value. However, because the output of the comparator 40*c* remains unchanged, the voltage of the data electrode 401 remains at 0 V and the EL element continues to keep its stored electric charge even after the termination of the application of the scan voltage.

The lighting up of the EL elements connected to an even-numbered scan electrode is described hereinafter. As shown in FIG. 3, a scan voltage V301 is applied to the scan electrode 301 at t=t3. At the same timing, the switching circuit 40*d* selects the increment counter 40*e*. In addition, the increment counter 40*e* and the decrement counter 40*f* are both reset at the same timing and the increment counter 40*e* begins counting up from 0. Meanwhile, it must be noted here that the latch 40 stores the display data m for the next EL element 121.

In this case, because the display data m is greater than the count value of the increment counter 40*e*, the output of the comparator 40*c* remains unchanged and because the voltage V401 of the data electrode 401 is at 0 V, the EL element 121 begins to light up.

When the count value of the increment counter 40*e* becomes m (t=t4), the output of the comparator 40*c* inverts, the voltage V401 of the data electrode 401 becomes Vm and so, the EL element 121 is deactuated. In this case, the above-described value m of the display data is for setting the timing of the termination of the application of the actuating voltage and so, brightness control of the EL element 121 can be performed by adjusting the value m of the display data.

The trace for voltage V402 shows the signals on subsequent data electrode 402, and the traces for voltages V112 and V122 show the potential differences at subsequent EL elements 112 and 122, respectively.

As explained in the above, brightness control display of the rows of the display panel 1 can be performed by adjusting the period of application of the actuating voltages to the odd-numbered and even-numbered scan electrodes. In this way, both demands for brightness control and the retention of electric charge in the EL elements can be satisfied by adjusting the timing for starting the application of the actuation voltage to the odd-numbered scan electrode, adjusting the timing for terminating the application of the actuation voltage to the even-numbered scan electrode and by retaining the actuation voltage during these operations.

It must be noted here while the display data in the above-described explanation is data for actuating (i.e., lighting up) the EL elements, display data for deactuating (i.e., putting out) the EL elements may also be used. In this case, the value n of the display data for the odd-numbered scan electrode is set to 0 while the value m of the display data for the even-numbered scan electrode is also set to 0. Accordingly, for the odd-numbered row, the timing for starting the actuation of the EL element will not occur while scanning voltage is being applied and, for the even-numbered row, the timing for ending the application of the actuating voltage will never come because m will never exceed the display data and so, the application of the actuating voltages to the data electrodes for both cases would be prevented.

A second embodiment of the present invention is explained hereinafter. According to the first embodiment, when the display data for the odd-numbered and even-numbered scan electrodes are deactuating and actuating data, respectively, as shown in V401 (I) of the timing chart of FIG. 5, a voltage of 0 V is applied to the data electrode 401 at t=t3 at the same time as the application of the scan voltage. However, under practical conditions, if the charging time of an EL element is to be considered, the EL element starts to light up only after the end of such charging time.

Figure 5:
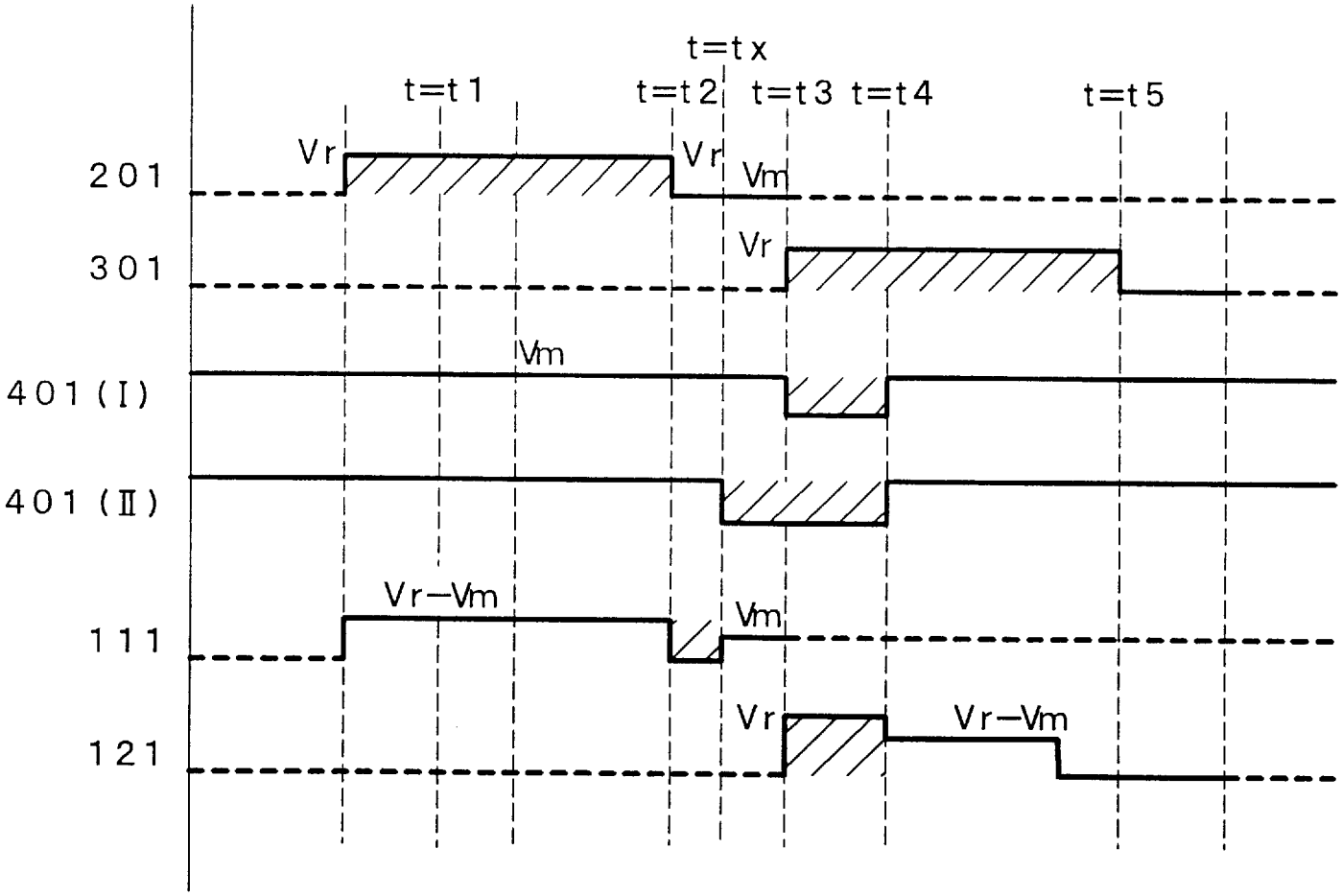
FIG. 5 is a time chart showing the operation of the EL display device according to the second embodiment.

Accordingly, in the present embodiment, as shown by V401 (II) of FIG. 5, the actuating voltage is applied (at t=tx of FIG. 5) before the application of the scan voltage.

The traces for voltages V201, V301 and V121 shown in FIG. 5 are similar to the corresponding signals previously described in connection with FIG. 3.

Figure 4:
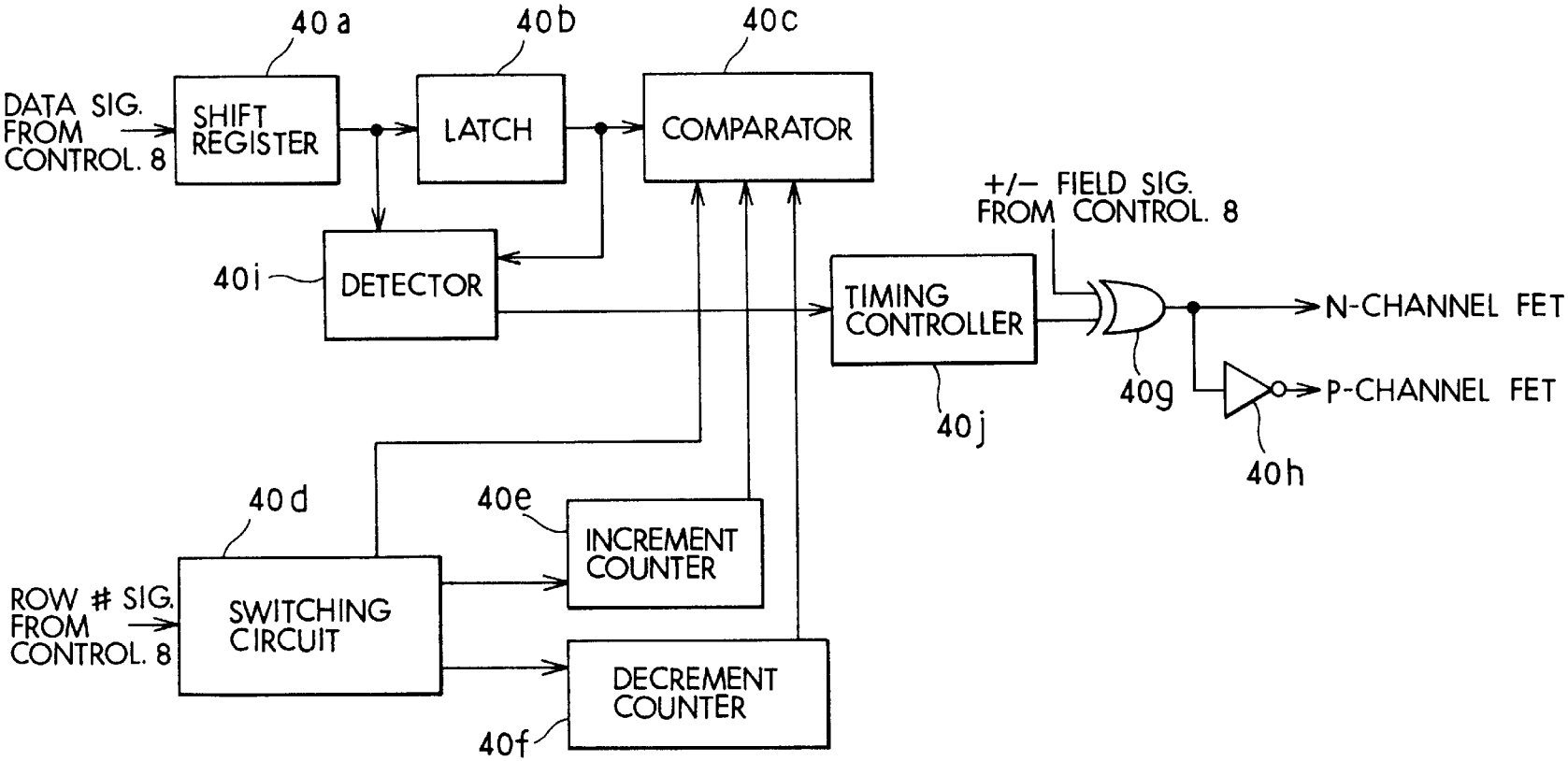
FIG. 4 is a block diagram of a circuit for performing brightness control according to a second embodiment of the present invention.

Thus, as shown in FIG. 4, a detector 40*i* and a timing controller 40*j*, which is for controlling the timing of the actuation of the EL element based on a detection signal from the detector 40*i*, are additionally provided to the circuit shown in FIG. 2.

The detector 40*i* generates a detection signal to the timing controller 40*j* after determining that the next scanning operation is on an even-numbered scan electrode based on the signal from the controller 8 and detecting that the display data for the even-numbered scan electrode and the odd-numbered scan electrode are deactuating data and actuating data, respectively, based on signals from the shift register 40*a* and the latch 40*b*. Upon receipt of the detection signal, the timing controller 40*j* starts the application of the actuating voltage at t=tx after the termination of the application of the scan voltage to the odd-numbered scan electrode.

A third embodiment of the present invention is explained hereinafter. According to the first embodiment, as shown in V401 (I) of the timing chart of FIG. 6, the actuating voltage is applied to the data electrode 401 until t=t3 when such voltage application is stopped synchronous to the application of the next scan voltage. However, at t=t3, with scan voltage being applied to the even-numbered scan electrode, there is a possibility that a nonactuated EL element might light up in consideration of the discharge time of the EL element 111.

Figure 6:
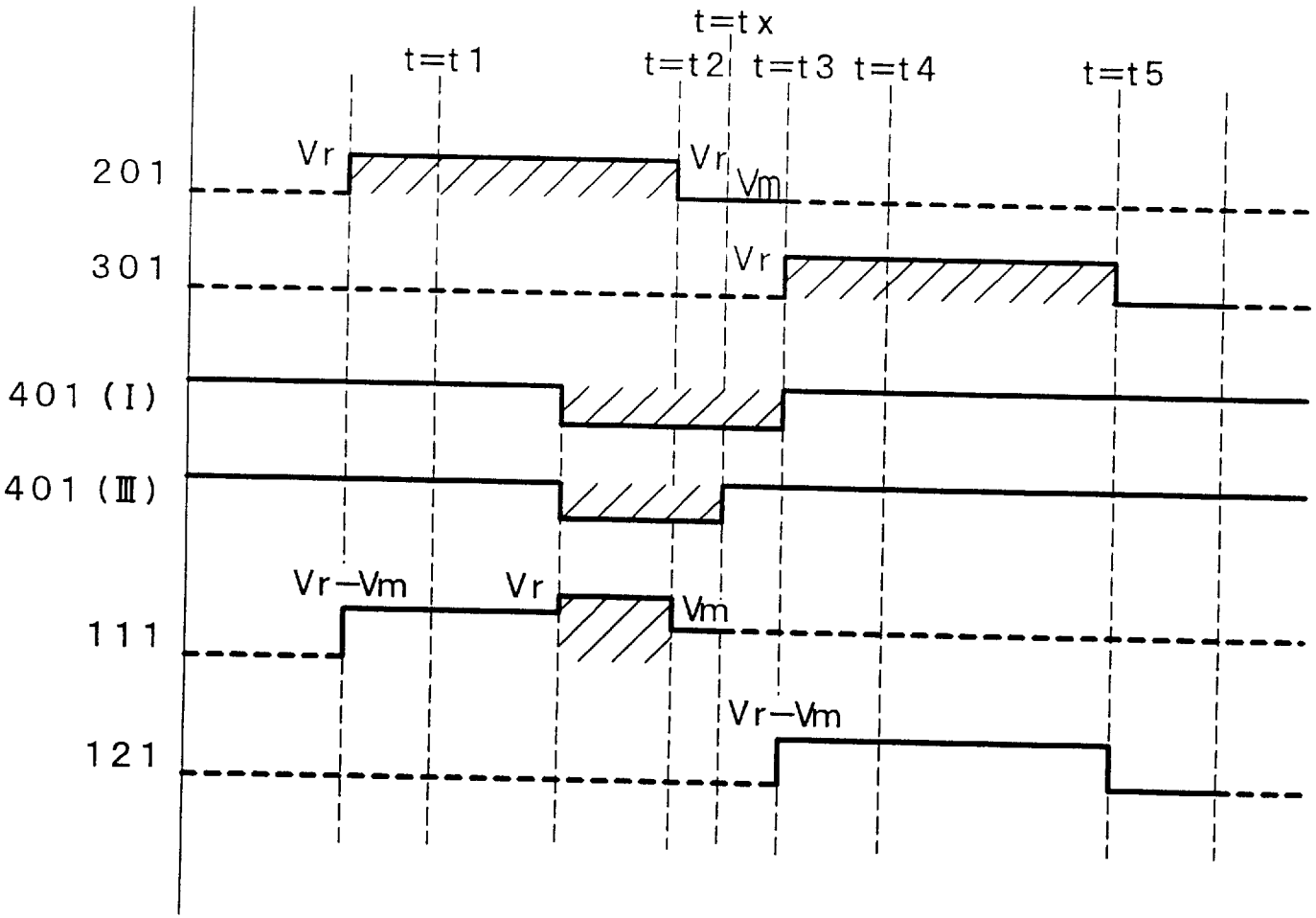
FIG. 6 is a time chart showing the operation of the EL display device according to a third embodiment of the present invention.

The traces for voltages V201, V301 and V121 shown in FIG. 6 are similar to the corresponding signals previously described in connection with FIG. 3.

In this way, in the present embodiment, as shown in V401 (III) of FIG. 6, the application of an actuating voltage to the data electrode 401 is terminated at time t=tx before the application of the scan voltage to the even-numbered scan electrode 301. In this case, using the same circuit shown in FIG. 4, the detection circuit 40*i* provides a detection signal to the timing controller 40*j* after detecting the scanning of the odd-numbered row based on a signal from the controller 8 and determining that the display data for the odd-numbered and even-numbered rows are actuating data and deactuating data, respectively, based on signals from the shift register 40*a* and the latch 40*b*. The timing controller 40*j* is for terminating the application of the actuating voltage at t=tx after terminating the application of the scan voltage to the odd-numbered scan electrode. It must be noted here that the features of the second and third embodiments may be combined.

A fourth embodiment of the present invention is explained hereinafter. While the first embodiment describes a construction in which both the brightness display control when data for the even-numbered scan electrodes and the odd-numbered scan electrodes are both actuating data and the electric charge retention of the EL elements, the present embodiment, regardless of whether the scanning electrode is even-numbered or odd-numbered, addresses both needs for the brightness control display for two continuous rows when their display data are actuating data and the electric charge retention of the EL elements.

Figure 7:
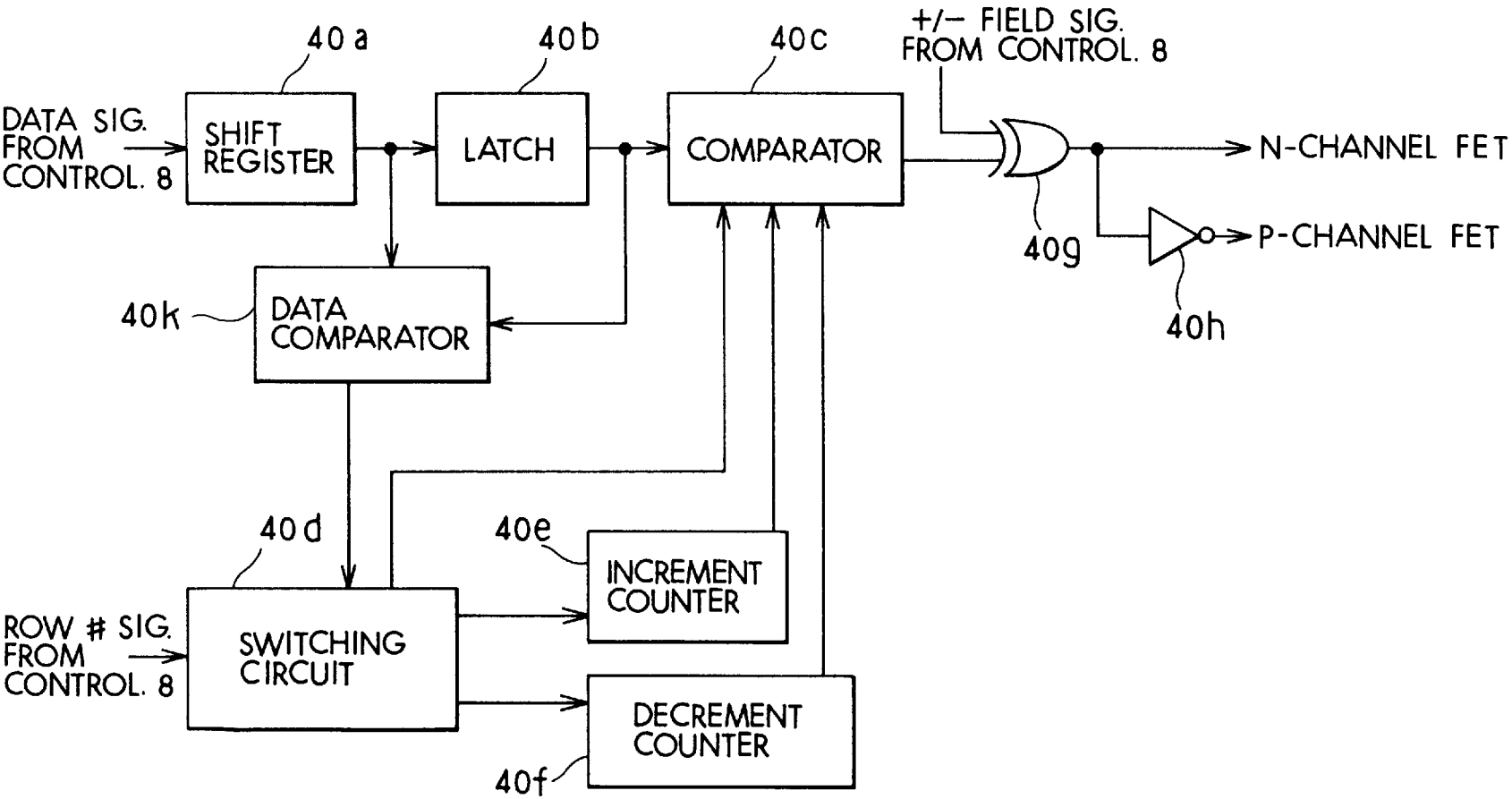
FIG. 7 is a block diagram of a circuit for performing brightness control according to a fourth embodiment of the present invention.

A circuit construction according to the present embodiment is shown in FIG. 7. According to the present embodiment, normally, brightness control is performed only using the decrement counter 40*f*. In other words, brightness display is performed after adjusting the timing for starting the application of the actuating voltage to the data electrode based on a countdown operation from the start of the application of the scanning voltage.

As shown in FIG. 7, the present embodiment includes a data comparator 40*k* which receives data from the shift register 40*a* and the latch 40*b* and determines if both the present and the next scanning display data are actuating data or not. If so, the data comparator 40*k* provides a signal, which indicates that both the present and next display data are actuating data, to the switching circuit 40*d*. Upon receipt of such signal, the switching circuit 40*d* performs the switching from the decrement counter 40*f* to the increment counter 40*e*. Thus, for the next scanning, the timing for terminating the application of the actuating voltage is adjusted in the same way as that of the first embodiment.

Figure 8:
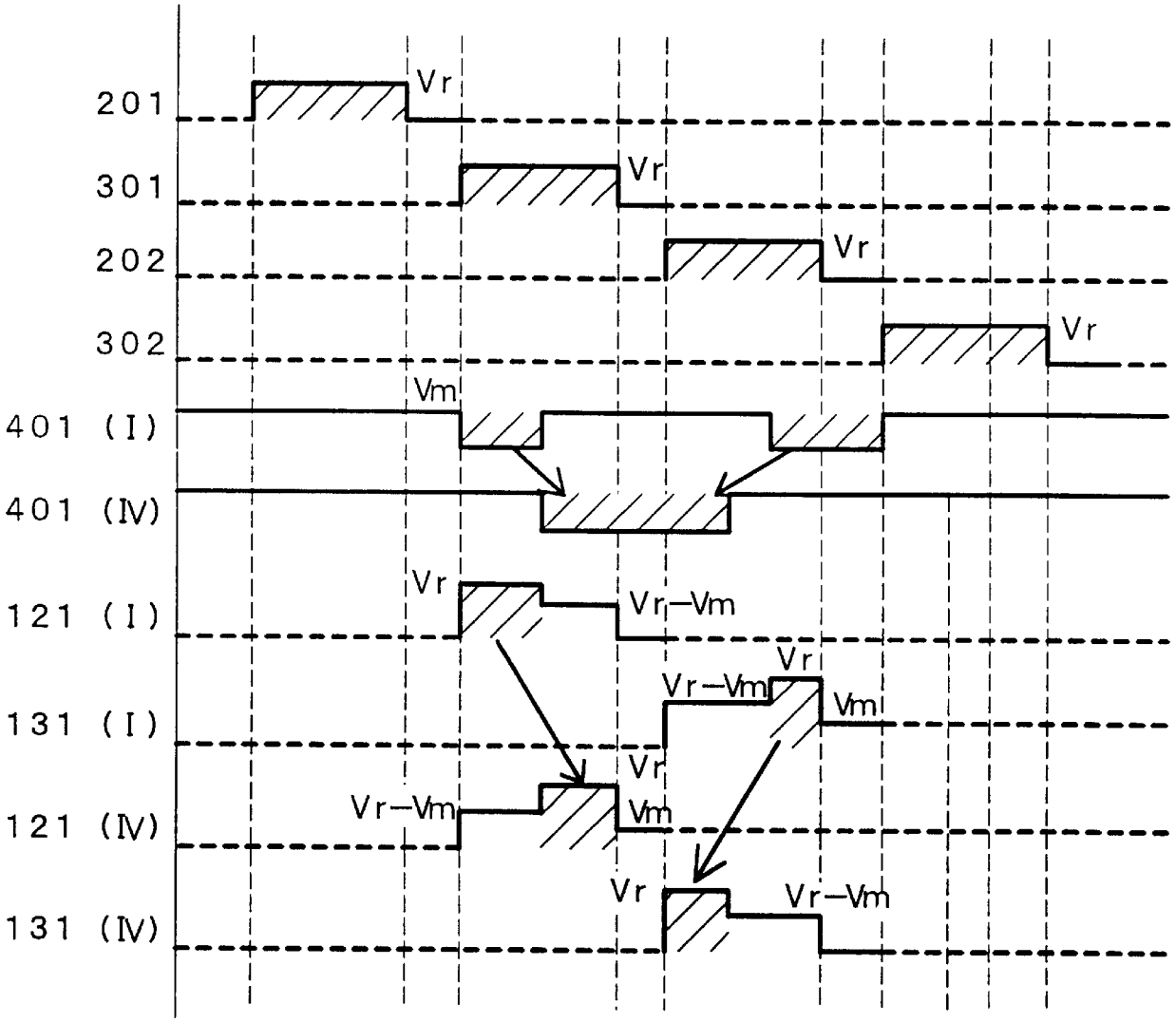
FIG. 8 is a time chart showing the operation of the EL display device according to the fourth embodiment.

As shown by V401 (I) of FIG. 8, when both the data for the even-numbered and odd-numbered scan electrodes are both actuating data, while the first embodiment cannot maintain the charge of the EL elements because both actuating voltages cannot be maintained, as shown in V401 (IV) of FIG. 8, the present embodiment can maintain the actuating voltages by making the actuating data continuous based on the above-described control procedure. In this way, energy consumption with the present embodiment is less than that of the first embodiment. In the present embodiment, the waveforms V121 (I), V131 (I) of EL elements 121, 131 in the first embodiment change to become waveforms V121 (IV) and V131 (IV). It must be noted here that the teaching of the present embodiment may be combined with those of the second and third embodiments.

The traces for voltages V201, V301 and V121 shown in FIG. 8 are similar to the corresponding signals previously described in connection with FIG. 3.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. An electroluminescent display device comprising:

a display panel having a plurality of scan electrodes, a plurality of data electrodes perpendicular to said scan electrodes and a plurality of electroluminescent elements disposed in intersections of said scan electrodes and said data electrodes and said plurality of electroluminescent elements are connected to said scan electrodes and said data electrodes;

scan driving means for sequentially applying scan voltages to said plurality of scan electrodes of said display panel; and data driving means for performing brightness control of said electroluminescent elements by applying actuating and deactuating voltages to said data electrodes in accordance with display data, said display data being one of actuating and deactuating data when correspond to said actuating voltage and said deactuating voltage for actuating and deactuating said electroluminescent elements of said display panel, said data driving means being for adjusting a first timing for starting application of said actuating voltage to a target data electrode among said plurality of data electrodes in accordance with a first one of two successive data for said target data electrode when both of said successive data are actuating data, said data driving means being for adjusting a second timing for terminating application of said actuating voltage to said target data electrode in accordance with a second one of said successive data while both of said successive data are actuating data, said data driving means being for maintaining said application of said actuating voltage between said first timing and said second timing when both of said successive data are actuating data.

2. An electroluminescent display device according to claim 1, wherein:

said data driving means is for performing brightness control by adjusting said first timing for starting said application of said actuating voltage to each of said data electrodes when said scan driving means applies said scan voltage to an odd-numbered scan electrode; and said data driving means is for performing brightness control by adjusting said second timing for terminating said application of actuating voltage to each of said data electrodes when said scan driving means applies said scan voltage to an even-numbered scan electrode.

3. An electroluminescent display device according to claim 2, wherein:

said data driving means starts said application of said actuating voltage to said target data electrode before said scan driving means applies said scan voltage to said even-numbered scan electrode connected to said target data electrode when said first one of said successive data is deactuating data for said target data electrode connected to said odd-numbered scan electrode to which said scan driving means applies said scan voltage and said second one of said successive data is actuating data for said target data electrode connected to said even-numbered scan electrode to which said scan driving means applies said scan voltage.

4. An electroluminescent display device according to claim 3, wherein:

said data driving means terminates said application of said actuating voltage to said target data electrode before said scan driving means applies said scan voltage to said even-numbered electrode connected to said target data electrode when said first one of said successive data is actuating data for said target data electrode connected to said odd-numbered scan electrode to which said scan driving means applies said scan voltage and said second one of said successive data is deactuating data for said target data electrode connected to said even-numbered scan electrode to which said scan driving means applies said scan voltage.

5. An electroluminescent display device according to claim 2, wherein:

said data driving means terminates said application of said actuating voltage to said target data electrode before said scan driving means applies said scan voltage to said even-numbered electrode connected to said target data electrode when said first one of said successive data is actuating data for said target data electrode connected to said odd-numbered scan electrode to which said scan driving means applies said scan voltage and said second one of said successive data is deactuating data for said target data electrode connected to said even-numbered scan electrode to which said scan driving means applies said scan voltage.

6. An electroluminescent display device according to claim 1, wherein:

said data driving means includes a data comparator for determining if said first one and said second one of said successive data are both actuating data by comparing present display data and said new display data.

7. An electroluminescent display device comprising:

a display panel having a plurality of scan electrodes, a plurality of data electrodes perpendicular to said scan electrodes and a plurality of electroluminescent elements disposed in intersections of said scan electrodes and said data electrodes and said plurality of electroluminescent elements are connected to said scan electrodes and said data electrodes;

scan driving means for sequentially applying scan voltages to said plurality of scan electrodes of said display panel;

data driving means for performing brightness control of said electroluminescent elements by applying actuating and deactuating voltages to said data electrodes in accordance with display data, said display data being one of actuating and deactuating data which correspond to said actuating voltage and said deactuating voltage for actuating and deactuating said electroluminescent elements of said display panel, said data driving means being for adjusting application periods of applying said actuating and said deactuating voltages; and a controller for adjusting, when said display data for both first and second scan electrodes are both actuating data, a first timing for starting application of said actuating voltage in accordance with a first control signal when said scan driving means applies said scan voltage to said first scan electrode, for maintaining application of said actuating voltage until said scan driving means starts application of said scan voltage to said second scan electrode and for adjusting a second timing for terminating application of said actuating voltage in accordance with a second control signal while said scan driving means applies said scan voltage to said second scan electrode.

8. An electroluminescent display device according to claim 7, wherein said controller includes:

a time determination unit for determining said first and said second timing based on said first and said second control signals, respectively;

a timer which resets when said scan driving means applies said scan voltage to at least one of said first and second scan electrodes, said timer being for counting a value indicative of time lapse after said scan driving means applies said scan voltage to said at least one of said first and second scan electrodes; and a comparator for comparing said value counted by said timer and said first and said second timing determined by said time determination unit, said comparator starting said application of said actuating voltage when said value equals said first timing and said comparator terminating said application of said actuating voltage when said value equals said second timing.

9. An electroluminescent display device according to claim 7, wherein said controller further includes:

a memory unit for storing said display data; and a detector for determining if said new display data and said display data stored in said memory unit are both actuating data.

* * * * *